United States Patent [19]

Hoyt, Jr.

[11] Patent Number: 4,908,960

[45] Date of Patent: Mar. 20, 1990

[54] OVERSHOE

[75] Inventor: Dolph G. Hoyt, Jr., Los Angeles, Calif.

[73] Assignee: Principle Plastics, Gardena, Calif.

[21] Appl. No.: 230,317

[22] Filed: Aug. 9, 1988

[51] Int. Cl.[4] ..... A43B 3/16; A43B 3/18

[52] U.S. Cl. ..... 36/7.1 R

[58] Field of Search ..... 36/7.1 R, 7.2, 7.3, 36/50, 51, 54, 58.5, 89, 90, 1.5, 2 R

[56] References Cited

U.S. PATENT DOCUMENTS

| | | | |
|---|---|---|---|
| 1,476,826 | 12/1923 | Martin | 36/7.3 X |
| 1,604,954 | 11/1926 | Artz | 36/7.1 R |
| 2,297,656 | 9/1942 | Hollier | 36/58.5 X |
| 2,652,637 | 9/1953 | Hardman | 36/7.3 |
| 2,725,647 | 12/1955 | Hugger | 36/7.3 |
| 2,924,029 | 2/1960 | Rosen | 36/7.1 R |
| 4,538,368 | 9/1985 | Mugford | 36/7.1 R X |
| 4,547,981 | 10/1985 | Thais et al. | 36/89 |
| 4,704,810 | 11/1987 | Massengale | 36/7.1 R X |
| 4,713,895 | 12/1987 | Vallieres | 36/7.1 R X |

*Primary Examiner*—Donald Watkins

*Attorney, Agent, or Firm*—Plante, Strauss, Vanderburgh and Connors

[57] ABSTRACT

Disclosed is an overshoe including a sole section, shoe section, and ankle cover section having a flap which folds inwardly towards the inside ankle of the user. The flap is detachably secured in position by a fastener which is covered by the flap upon being folded inwardly.

5 Claims, 2 Drawing Sheets

OVERSHOE

BACKGROUND OF THE INVENTION

1. Field of the Invention:

This invention relates to overshoes or boots, and particularly, relates to an overshoe which is easy to use and to fasten.

2. Background Discussion:

Overshoes are conventional articles of clothing which are used to cover ordinary shoes and footwear during rainy or snowy weather. These overshoes include a lower foot section which is attached to a sole and an upwardly projecting ankle section which has an enlarged open end which allows the user to insert his or her foot. Typically, the upper section has a flap which expands and then is closed or folded to restrict the enlarged opening once the user has placed his or her foot into the overshoe. It is conventional practice that this flap be closed at the front and folded over the outside of the ankle. The reason that it is folded over on the outside of the ankle rather than on the inside of the ankle is that the fasteners would interfere or catch each other during walking. Specifically, the outwardly projecting locking elements of the fasteners of, for example, the right foot would catch and ensnare the outwardly projecting locking elements of the fasteners of the left foot if the flaps were folded inwardly toward the inside ankles of the user.

SUMMARY OF THE INVENTION

Briefly, the overshoe of this invention includes a flap which is folded inwardly towards the inside ankle of the user and fastened in this position. The flap, in the folded position, covers, either partly or completely, a fastener. Thus, the fastener does not project outwardly from the overshoe during use, and cannot be ensnared by the fastener on the opposite boot. It is highly desirable to have the flap fold inwardly towards the inside ankle In order to facilitate placing the overshoe on the foot of the user. The user may simply cross his or her leg, pull the overshoe onto the foot, and then fold the flap inwardly towards the inside ankle and secure it with the fastener. Preferably, a hook and pile fastener is used such as the type sold by the Velcro Corporation. According to the present invention, the flap covers the fastener so that the fastener would not catch the other overshoe. When the flap is folded toward the inside ankle, the outside of the boot has an uncluttered, streamlined appearance.

There are several features of this invention which contribute to its convenience, no single one of which is solely responsible for this desirable attribute. Without limiting the scope of this invention as expressed by the claims, all its features will be pointed out in the section of this application entitled DETAILED DESCRIPTION OF THE PREFERRED EMBODIMENT.

BRIEF DESCRIPTION OF THE DRAWING

The drawing, which is for illustrative purposes only, depicts the preferred embodiment of this invention in which.

DESCRIPTION OF THE PREFERRED EMBODIMENT

Figure 1:
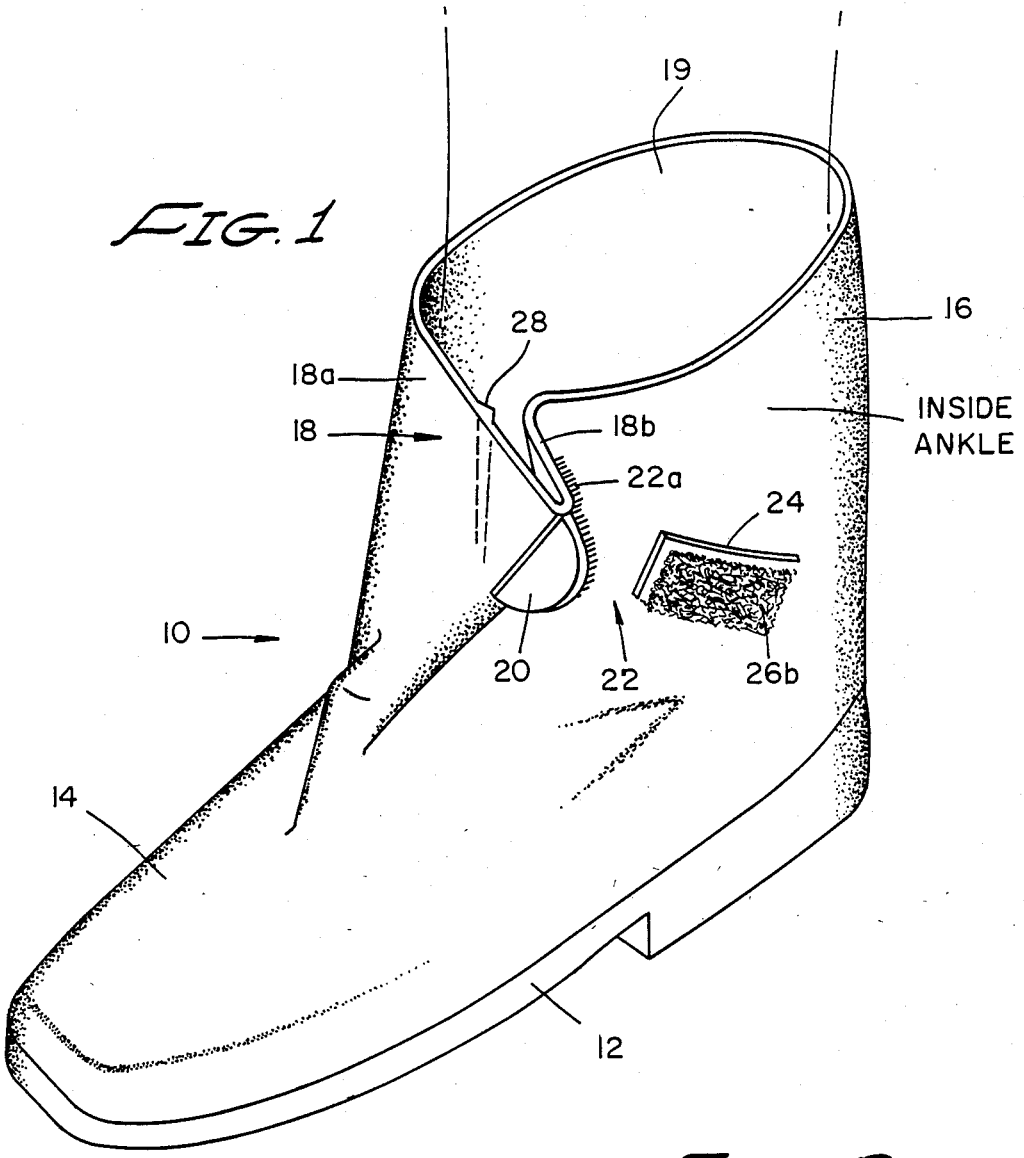
FIG. 1 is a perspective view of a user inserting his or her foot into the overshoe of this invention and closing the flap over the fastener.
Figure 2:
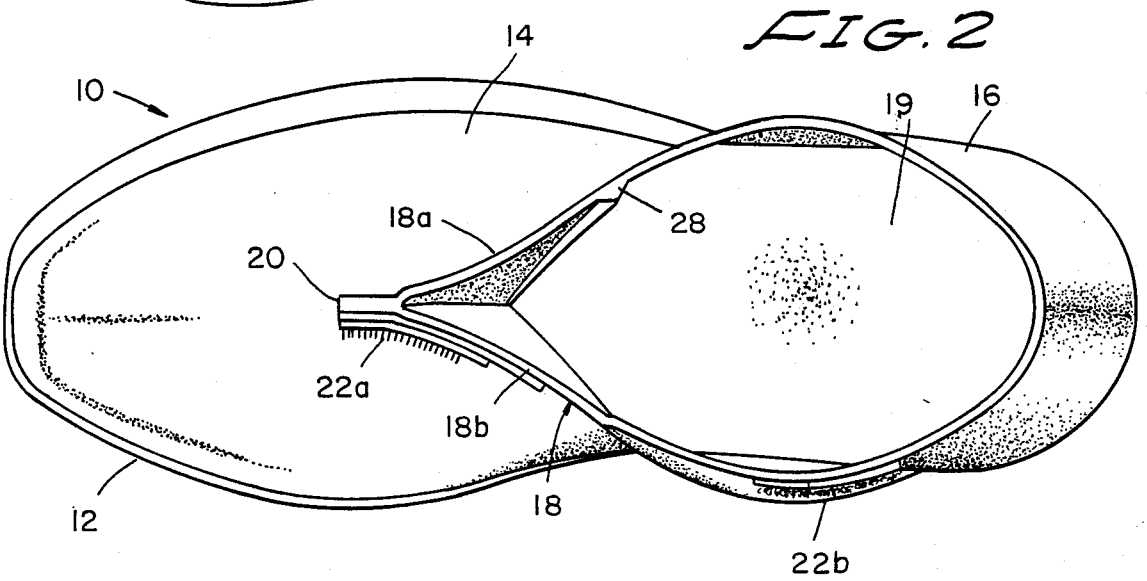
FIG. 2 is a plan view of the overshoe of this invention.
Figure 3:
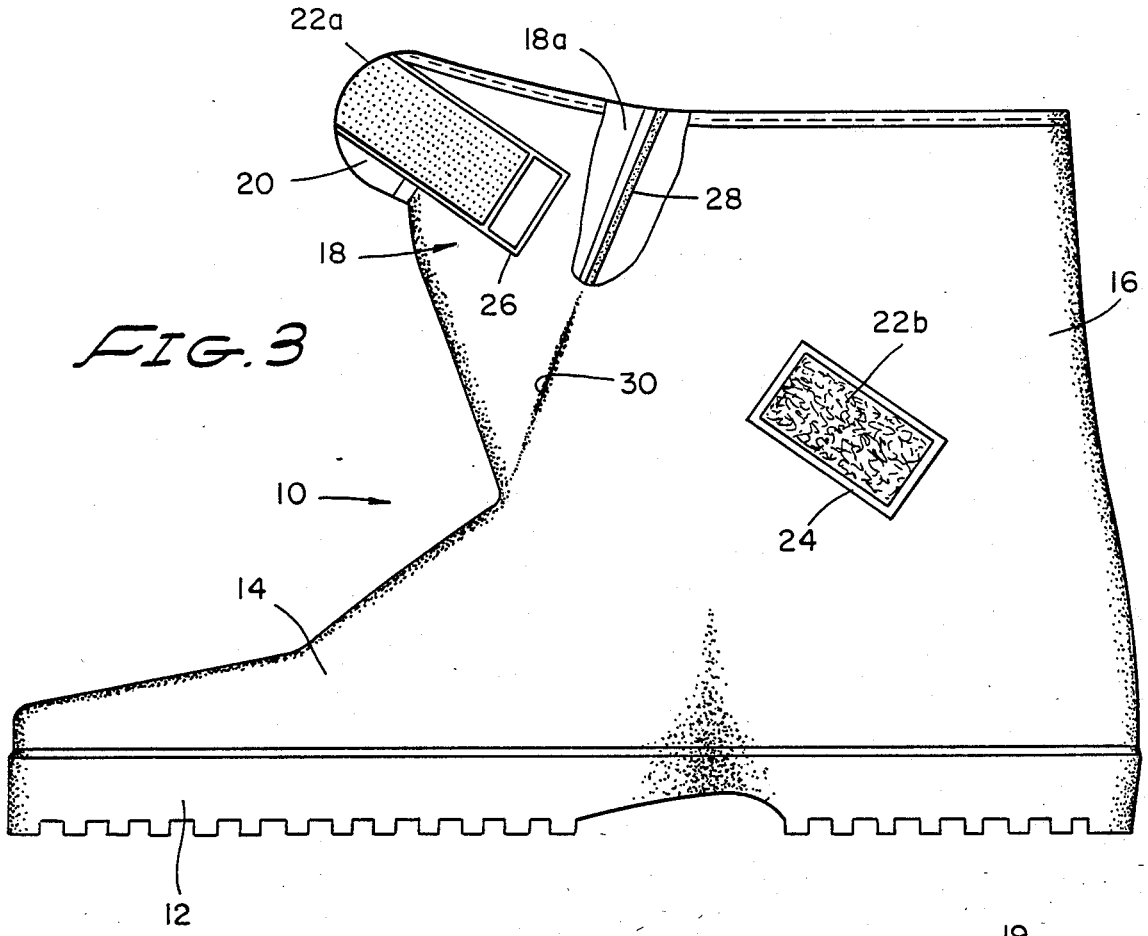
FIG. 3 is a side elevational view of the overshoe of invention with the flap in an unfolded condition.
Figure 4:
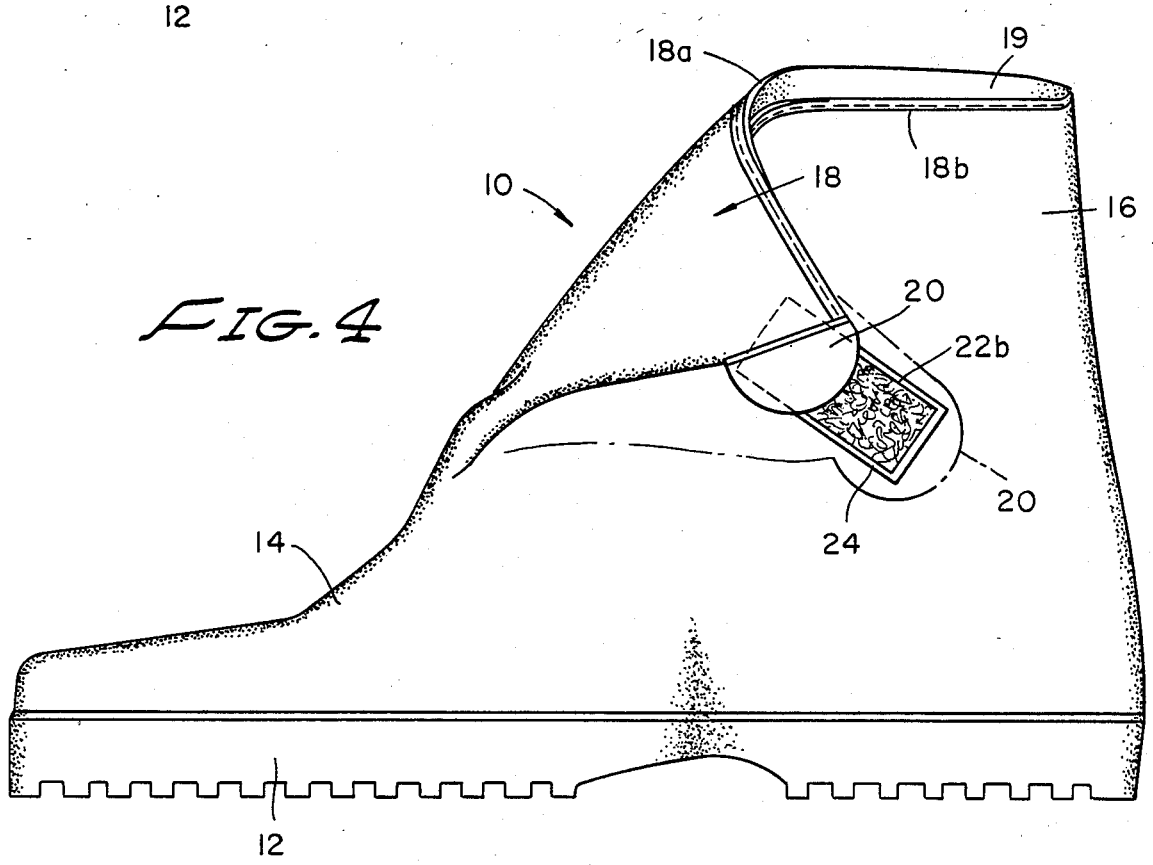
FIG. 4 is a side elevational view of the overshoe of this invention with the flap folded over and fastened in position.

As shown in FIGS. 1 through 4, the overshoe 10 of this invention includes a sole section 12, a lower shoe section 14 which conforms generally to the shape of a shoe, and an upper ankle cover section 16. The sole section 12, shoe section 14, and ankle cover section 16 are preferably integral and are formed from a polyvinylchloride polymer in a molding process. The boot may be made to size or designed to stretch to fit several different sizes of shoes.

In accordance with this invention, the upper ankle cover section 16 includes a flap 18 which folds inwardly toward the inside ankle of the user. This flap 18 consists of two walls **18*a* and 18*b* making up the ankle cover section 16 and it projects forwardly generally along the longitudinal axis of the overshoe 10. These two walls 18*a* and 18*b* define an opening 19 to allow the user's foot to be inserted into the overshoe 10. The two walls 18*a* and 18*b* of the upper ankle cover section 16 join together at their forward end to form a rounded tab member 20 which is generally located at the apex of the flap 18. This flap 18, when folded inwardly over the inside ankle, has a generally triangular configuration (FIG. 4) with the tab 20 at the apex of this triangular configuration overlying the ankle of the user. When the flap 18 is folded inwardly, it restricts the enlarged opening 19 formed by the two walls 18*a* and 18*b***.

A fastener 22 is employed which preferably is a pile and hook type fastener such as a Velcro fastener sold by the Velcro Corporation. On the inside wall **18*b* there are two generally rectangular zones 24 and 26 which form a slight indentation or well. These indentations or wells 24 and 26 are used to confine an adhesive which is used to glue the two elements 22*a* and 22*b* of the fastener 22 in their respective locations on the wall 186. The preferred type of adhesive used to secure the two elements 22*a* and 22*b* of the fastener 22** in position is of a water resistant composition such as a cyanoacrylate esther-based adhesive. Preferably it is a fast drying type.

Preferably a hook element **22*a* is secured in the indentation 26 and a pile element 22*b* in the indentation 24. This is not necessary and their positions could be reversed. It is important that the element 22*a* on the flap 18 extend all the way to the edge of the tab 20 so that, when the fastener 22 is closed, the tab will be secured snugly and flush against the element 22*b*, minimizing any outward projection of the elements 22*a* or 22*b*. In other words, when the flap 18 is folded and the hook elements embed themselves in the pile, the tab 20 is held snugly against the wall 18*b*** and does not curl outwardly.

The other wall **18*a* has a ridge 28 formed by a thickening of the wall along a line which extends generally along the curve of the foot and leg. This inner wall 18*b* has a crease 32 along a line which extends generally along the curve of the foot and leg. The ridge 28 biases the outer wall 18*a* of the flap 18 so that it tends to fold inwardly along the crease 30** towards the inside ankle.

The overshoe 10 of this invention is easy to use. The user simply grasps the two walls **18*a* and 18*b*, one with each hand, pushing his or her foot through the enlarged opening 19 into the overshoe 10. The user may cross his leg. If the user does so, he or she then simply folds the flap 18 over, engaging the hook element 22***a* with the pile element 22*b*. The ridge 28 and crease 30 bias the flap 18 to fold inwardly. The user may adjust the position of the hook element 22*a* with the pile element 22*b*. The user may adjust the position of the hook element 22*a* with respect to the pile element 22*b*, as shown in dotted lines in FIG. 4, to regulate the size of the opening 19 to make the opening either larger or small. The flap 18 may either completely or partially cover pile element 22*b* upon being folded over, as required to hold the overshoe 10 securely to the foot of the user. When the flap 18 has been folded over and the fastener 22 engaged, the flap tends to lie close to the wall 18*b* with a minimum tendency to project outwardly from the inside of the foot and leg of the user. Thus, there is little likelihood that this flap 18 will catch the flap of the other overshoe when the user has both overshoes on and is walking.

SCOPE OF THE INVENTION

The above description presents the best mode contemplated of carrying out the present invention as depicted by the preferred embodiment disclosed. The combination of features illustrated by this embodiment provide the convenience of this invention. This invention is, however, susceptible to modifications and alternate constructions from the embodiment shown in the drawing and described above. Consequently, it is not the intention to limit it to the particular embodiment disclosed. On the contrary, the intention is to cover all modifications and alternate constructions falling within the scope of the invention as generally expressed by the following claim.

I claim:

1. An overshoe comprising a sole and, connected to the sole, a body portion having a lower section conforming to the shape of a shoe and an upper section extending upwardly from the lower section to cover an ankle of a user, said upper section having an enlarged open end into which a foot of a user is easily inserted and a forwardly extending flap section which folds inwardly over the ankle towards the inside ankle to restrict the size of the open end, said flap section being formed from two wall elements, one wall element being on the outside of the ankle of a user and the other wall element being on the inside of the ankle of the user, and a fastener attached to the body portion at an inside position to detachably secure the flap section to the body portion, said flap section at least partially covering the fastener on being folded inwardly over the inside ankle of a user, said fastener including a first member secured to the wall element on the inside of the ankle of the user and a second member secured to the body portion, one member being a pile type element and the other member being a hook type element, said first and second members being covered by the flap section upon folding said section inwardly over the inside of the ankle of the user and securing the fastener.

2. An overshoe comprising a sole and, connected to the sole, a body portion having a lower section conforming to the shape of a shoe and an upper section extending upwardly from the lower section to cover an ankle of a user, said upper section having an enlarged open end into which the foot of a user is easily inserted and a forwardly extending flap section which folds inwardly towards the inside ankle to restrict the size of the open end, said flap section having a triangular configuration upon being folded inwardly and a tab at the apex of said triangular configuration to facilitate folding and unfolding said flap section, with said flap section being formed from two walls elements comprising the upper section, one of said wall element being on the outside of the ankle of the user and having a ridge therein which biases the flag section to fold inwardly toward the inside ankle of the user, a fastener for detachably securing the flap section to the body portion, said fastener including a first member secured to the flap section and a second member secured to the body portion, one member being a pile type element and the other member being a hook type element, said one member attached to the flap section extending to the edge of the tab member, and said first and second members being covered by the flap section upon folding said flap section inwardly securing the fastener.

3. The overshoe of claim 2 wherein the first and second members of the fastener are secured to the body portion by a water resistant adhesive.

4. The overshoe of claim 2 wherein the other of said wall members has a crease therein which biases the flap section to fold inwardly toward the inside ankle of the user.

5. An overshoe comprising a sole, and connected to the sole, a body portion having a lower section conforming to the shape of a shoe and an upper section extending upwardly from the lower section to cover an ankle of a user, said upper section having an enlarged open end into which a foot of a user is easily inserted, said upper section including a pair of wall elements which are joined together to form a flap section, one wall element having a ridge therein and the other wall element having a crease therein, said ridge and crease being generally aligned to facilitate the flap section being folded by a user over the ridge and crease into a triangular configuration, with the flap section adapted to fold inwardly towards the inside ankle to restrict the size of the open end, and a fastener having a first element attached to the flap section and a second element attached to the body portion, said flap section at least partially covering the fastener on being folded inwardly over the inside ankle of a user.

* * * * *